US009282840B2

(12) United States Patent
Moscato

(10) Patent No.: US 9,282,840 B2
(45) Date of Patent: Mar. 15, 2016

(54) DEVICE FOR PUTTING ON TIGHTS AND GARMENTS OF SIMILAR KIND

(71) Applicant: Giuseppe Moscato, Rome (IT)

(72) Inventor: Giuseppe Moscato, Rome (IT)

( * ) Notice: Subject to any disclaimer, the term of this patent is extended or adjusted under 35 U.S.C. 154(b) by 0 days.

(21) Appl. No.: 14/390,855

(22) PCT Filed: Mar. 28, 2013

(86) PCT No.: PCT/IT2013/000092
§ 371 (c)(1),
(2) Date: Oct. 6, 2014

(87) PCT Pub. No.: WO2013/150554
PCT Pub. Date: Oct. 10, 2013

(65) Prior Publication Data
US 2015/0053729 A1 Feb. 26, 2015

(30) Foreign Application Priority Data
Apr. 4, 2012 (IT) ..... RM2012A0138

(51) Int. Cl.
*A47G 25/90* (2006.01)
*A47G 25/82* (2006.01)

(52) U.S. Cl.
CPC ..... *A47G 25/905* (2013.01); *A47G 25/907* (2013.01)

(58) Field of Classification Search
CPC ... A47G 25/90; A47G 25/905; A47G 25/907; A47G 25/80; A47G 25/82
USPC ..... 223/111, 112
See application file for complete search history.

(56) References Cited

U.S. PATENT DOCUMENTS

| | | | | |
|---|---|---|---|---|
| 1,238,432 | A * | 8/1917 | Orr | 223/119 |
| 2,982,453 | A * | 5/1961 | Zicarelli | 223/112 |
| 4,744,333 | A * | 5/1988 | Taylor | 119/850 |
| 5,630,534 | A * | 5/1997 | Maier et al. | 223/112 |
| 8,393,503 | B2 * | 3/2013 | Moscato | 223/112 |

FOREIGN PATENT DOCUMENTS

| | | | |
|---|---|---|---|
| EP | 1 442 686 | A1 | 8/2004 |
| GB | 1 562 307 | A | 3/1980 |
| WO | 2011/085439 | A1 | 7/2011 |

OTHER PUBLICATIONS

International Search Report, dated Aug. 16, 2013, from corresponding PCT application.

* cited by examiner

*Primary Examiner* — Ismael Izaguirre
(74) *Attorney, Agent, or Firm* — Young & Thompson

(57) ABSTRACT

A device for putting on tights and garments of similar kind, includes: a pair of shoehorns (1', 1") onto which it is possible to slip on and maintain in position of stable opening tights (CL) or garments of similar kind; engagement elements (4) for strengthening the grip of the shoehorns (1', 1") onto the garment slipped on and kept into opening position thereon; handles (5) for gripping and handling, arranged for allowing the use of the device; and a coupling joint (9) arranged for allowing the reversible connection of the shoehorns (1', 1") to each other and the reciprocal movement thereof.

6 Claims, 3 Drawing Sheets

DEVICE FOR PUTTING ON TIGHTS AND GARMENTS OF SIMILAR KIND

BACKGROUND OF THE INVENTION

1. Field of the Invention

The present invention concerns the field of medical devices to assist the donning of socks, stockings, tights and similar garments.

More in detail, the present invention concerns a device for putting on tights and similar garments.

2. Description of the Related Art

It is known that to people with reduced (permanent or temporary) mobility, with obesity problems, recovering from surgery, pregnant or old, even the simple act of putting on tights or garment of similar kind may be a nearly insurmountable problem.

It is therefore the aim of the present invention to realize a device adapted to allow an easy and correct donning of tights, and garments of similar kind, without bending the torso or flexing the lower limbs.

In an earlier patent filed under No. RM2008A000327 on 20 Jun. 2008, by the same applicant of the present application, a device is described for putting on socks, stockings and elastic stockings.

Besides, the contemporary use of a couple of said devices allows to put on tights and similar garments, but necessarily requires very complex manoeuvres per persons with reduced mobility.

BRIEF SUMMARY OF THE INVENTION

It is therefore the aim of the present invention as well to overcome some problems deriving from the use of above mentioned device.

The aims set forth are reached by means of a device for putting on tights and garments of similar kinds, comprising:

- a pair of shoehorns onto which it is possible to slip on and maintain in position of stable opening tights or garments of similar kind;
- engagement means for strengthening the grip of said shoehorns onto the garment slipped on and kept into opening position thereon;
- handles for gripping and handling, arranged for allowing the use of the device, characterized in that it comprises:

- a coupling joint interposed between said shoehorns; wherein said coupling joint is arranged for allowing the reversible connection of the shoehorns to each other and the reciprocal movement thereof.

Further features of the device according to the present invention are contained in the dependent claims.

The advantages of the present invention are many and significant:

- it allows to put on autonomously and in the correct manner, and without physical stress graduated compression tights for containment and/or relaxing, graduated compression tights against venous stasis, supportive tights for pregnant women, tights with a general high compression factor and of other kind, and also similar garments like pantyhose, leggings and other;
- it allows people with reduced mobility to recover their autonomy;
- it has low production costs, is easy in use and does not require special maintenance.

BRIEF DESCRIPTION OF THE DRAWINGS

Further features and advantages of the present invention will be more evident from the following description wherein the enclosed drawings show by way of non-limiting example, a preferred embodiment, and wherein.

DETAILED DESCRIPTION OF THE PREFERRED EMBODIMENTS

Figure 1:
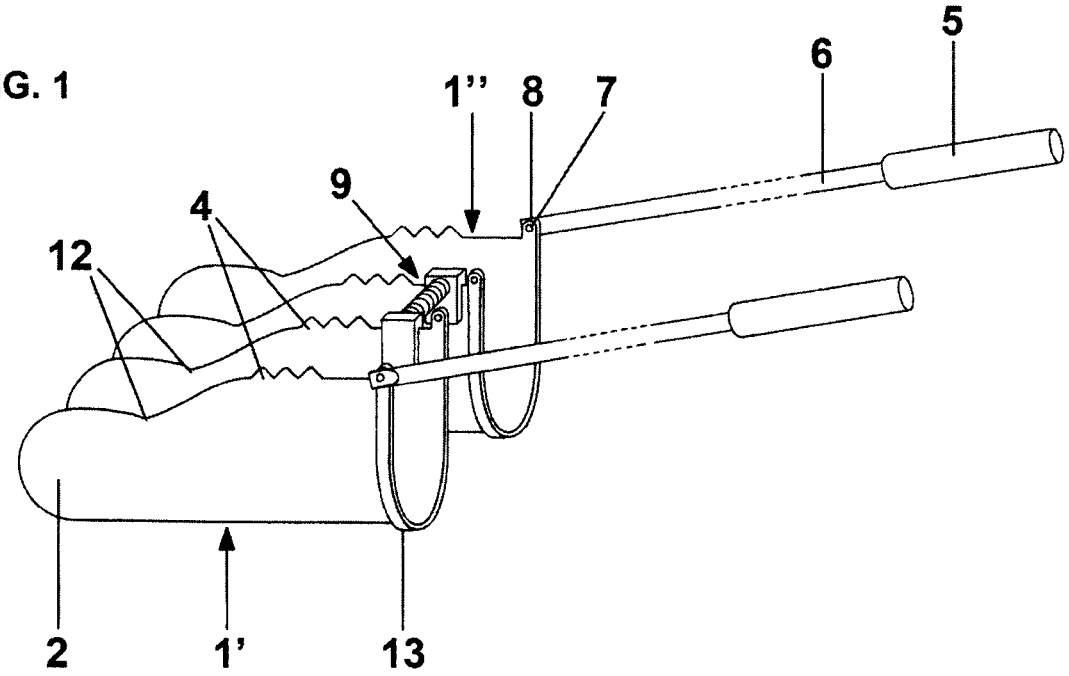
FIGS. 1 and 2 show an axonometric partially exploded view and a plan view of a device for putting on tights, or garments of similar kind, according to the present invention.
Figure 2:
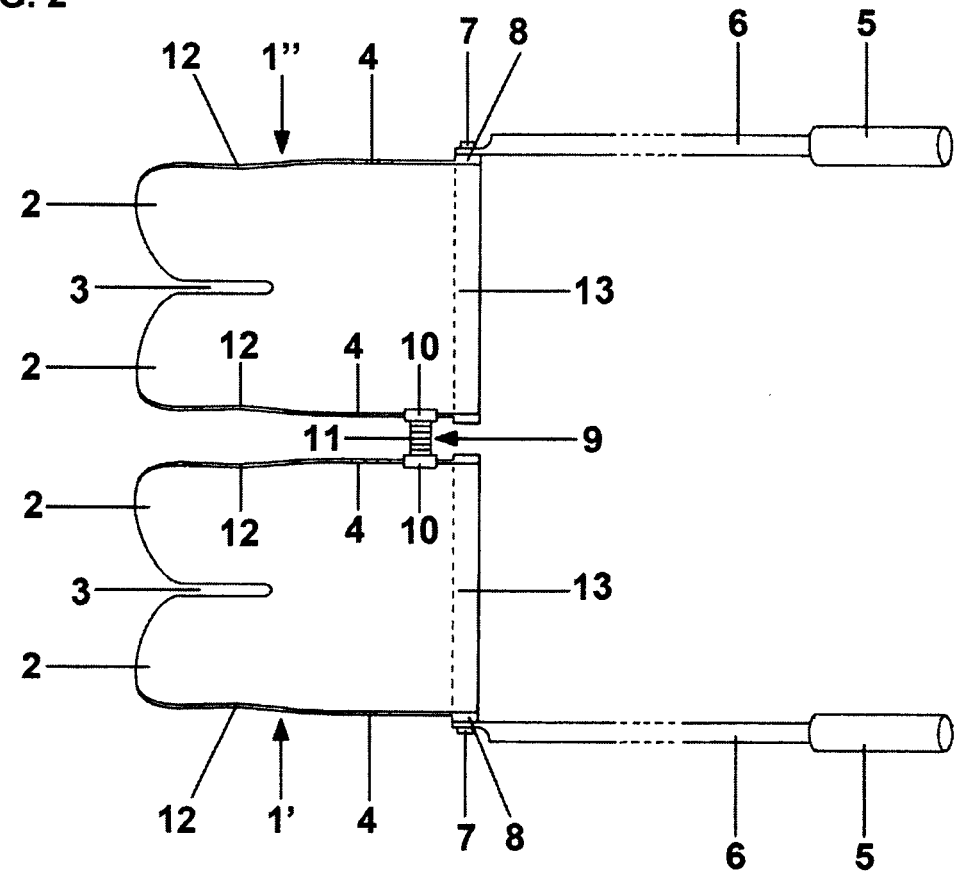
Figure 3:
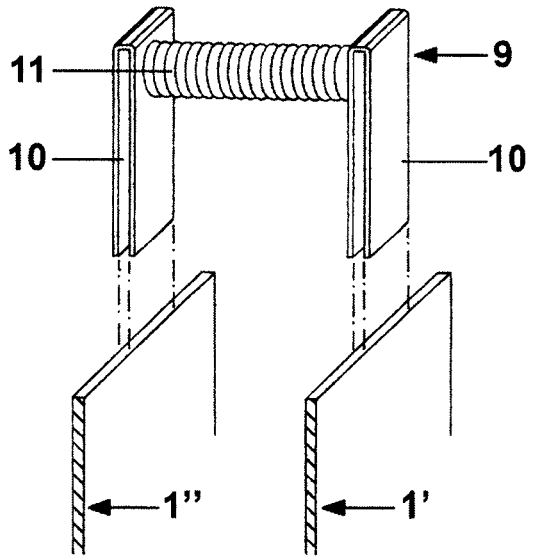
FIG. 3 shows a complete axonometric view of the structure of the coupling joint interposed between the shoehorns of said device.
Figure 4:
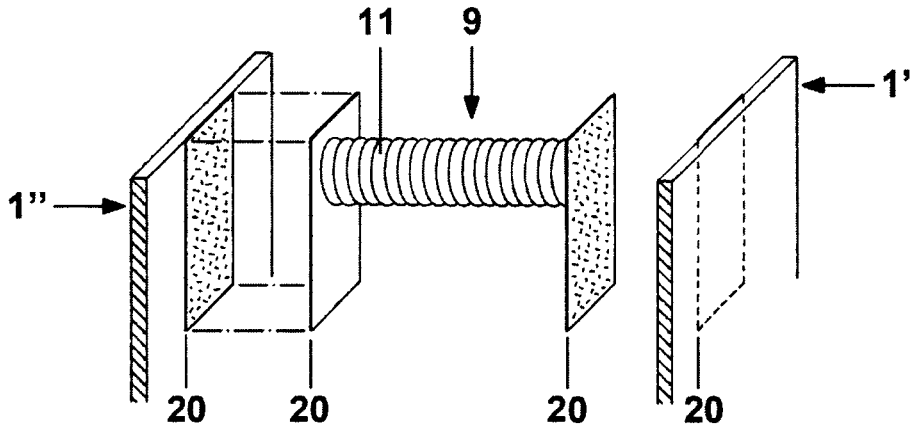
FIGS. 4 and 5 show, in a partially exploded axonometric view, some possible embodiments of said coupling joint.
Figure 5:
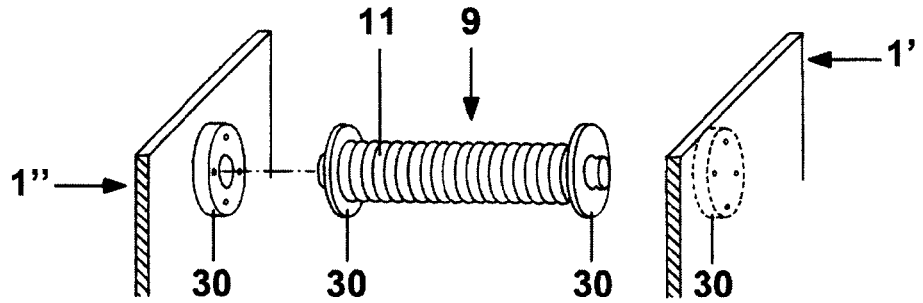
Figure 6:
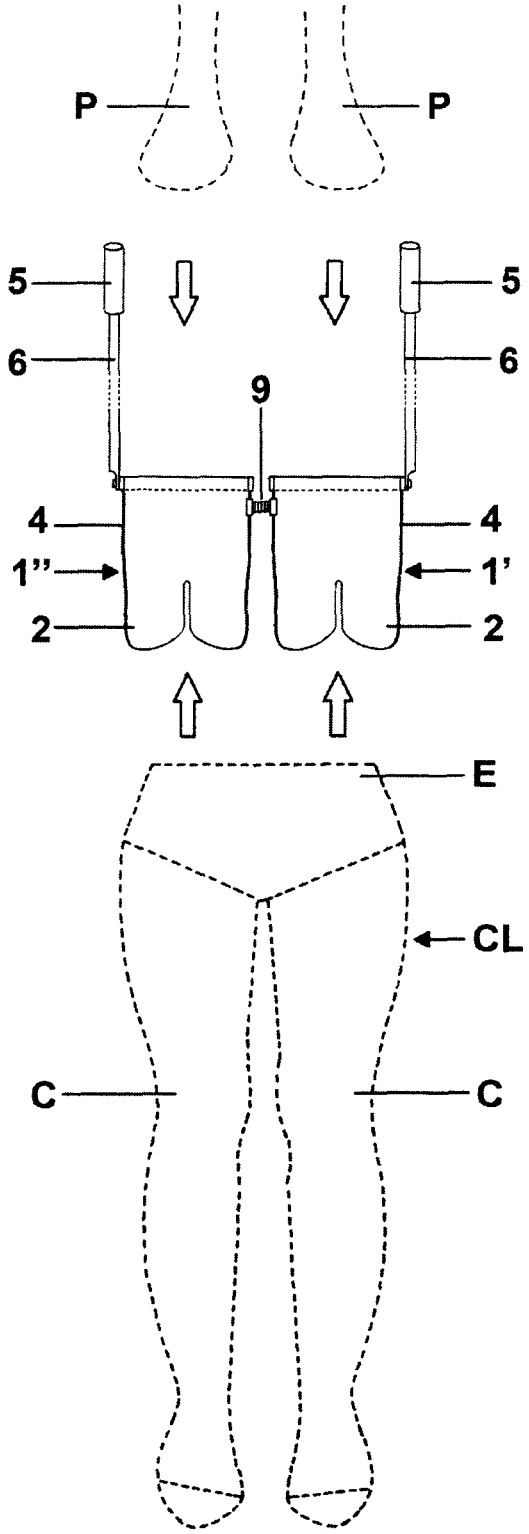
FIG. 6 shows in a simplified scheme the working principle of a device for putting on tights, or garments of similar kind, according to the present invention.

Relating to the details of the figures, the device according to the present invention mainly comprises:

- a pair of shoehorns 1', 1" onto which it is possible to slip on and maintain in position of stable opening tights CL or garments of similar kind, having an approximately semi-cylindrical shape and comprising rounded front ends 2, separated by one or more longitudinal slits 3;
- engagement means 4 for strengthening the grip of said shoehorns 1', 1" onto the garment CL slipped on and kept into opening position thereon, said means being placed on top of the lateral walls of said shoehorns 1', 1" and which may be of different shapes, dimensions and number, with the purpose of adjusting the grip thereof according to the different consistency of the materials forming said garment CL;
- handles 5 for gripping and handling, arranged for allowing the use of the device, associated with rods 6, fixed or of adjustable length, hinged by means of pins 7 onto joints 8 integral with the structure of shoehorns 1', 1", said pins 7 being arranged for allowing rotation of said shoehorns 1', 1".
- a coupling joint 9, adapted to allow the reversible connection between said shoehorns 1', 1", comprising a pair of grooved plates 10 that may be inserted onto the inner lateral adjacent walls of said shoehorns 1', 1" and reciprocally connected by means of a spring 11, or of an equivalent mechanical elastic element, like e.g. a linear element in rubber, or other.

According to the present invention, the device comprises a couple of shoehorns 1', 1" reciprocally connected by a coupling joint 9, comprising a pair of grooved plates 10 that may be inserted onto the internal lateral adjacent walls of said shoehorns 1', 1", and reciprocally connected by means of a spring 11, or of an equivalent mechanical elastic element, like e.g. a rubber jumper, or other.

In possible embodiments, above mentioned coupling joint 9 comprises, as an alternative to said grooved plates 10, quick reversible engagement means, like Velcro elements 20 or poppers 30, that may be applied to the inner lateral adjacent walls of shoehorns 1', 1" and as well reciprocally connected by means of a spring 11, or by means of an equivalent elastic mechanical element.

In a further embodiment, not shown, said coupling joint 9 may be integral with the inner lateral wall of one of the shoehorns 1', 1" and may be reversibly connected with the inner lateral wall of the other shoehorn 1', 1".

In addition, said shoehorns 1', 1" are further provided with gripping and moving handles 5, associated to rods 6, fixed or of adjustable length, applied to the external lateral walls of said shoehorns 1', 1" so as to allow the user to easily reach, without bending, the ends of his lower limbs.

Said rods 6 may be of telescopic kind, so as to allow the adjusting of their length, or of removable kind, so as to reduce the encumbrance of the device when not in use.

A tights CL, or a similar garment, may be slipped on said pair of shoehorns 1', 1", with the relative upper end E fixed to engagement means 4 of said shoehorns 1', 1", and the stockings C completely slipped on the front ends 2 of the same, so that the garment of interest is kept in a stable opening position.

The operations for putting tights CL, or the garment of interest, in position on shoehorns 1', 1" are made easier by the rounded shape of the relative front ends 2 and by the longitudinal slits 3 made in the structure of said shoehorns 1', 1" for increasing the overall flexibility.

Furthermore, the operations for placing tights CL, or the garment of interest, onto said shoehorns 1', 1" are advantageously made easier by the reciprocal movement of said shoehorns 1', 1" made possible by spring 11 comprised in coupling joint 9, interposed between said shoehorns 1', 1".

When the tights CL are placed on said shoehorns 1', 1", the user will grip the device by means of the gripping handles 5 and will insert, without bending, his feet P inside stockings C of tights CL, making then slide his lower limbs inside said shoehorns 1', 1" up to his/her thighs.

Under the push of the lower limbs of the user, said shoehorns 1', 1" rotate on said rods 6 of the gripping handles 5, hinged to relative joints 8 by means of pins 7, thus independently taking a position for facilitating the correct donning of said tights CL, appropriately positioned on the same.

Now the user will separate said shoehorns 1', 1" by completely or partially unhooking the coupling joint 9, he/she will slip off the shoehorns 1', 1" from his/her lower limbs acting on the gripping handles 5 and will manually complete the donning of the tights CL now nearly completely and correctly put on.

For making easy the donning of elastic containment tights, even with a high compression factor, shoehorns 1', 1" further comprise:

shapes 12, adapted to further increase the grip on said kinds of garments;

a reinforcement collar 13, adapted to prevent the squeezing thereof by the different kinds of mentioned garments, allowing a correct sliding of the user's lower limbs inside said shoehorns 1', 1" and consequently also the correct donning of said garments.

The invention claimed is:

1. A device for putting on tights and garments of similar kind, the device comprising:

a pair of shoehorns configured to receive by slipping on and maintaining in position of stable opening tights or garments of similar kind;

engagement means for strengthening the grip of said shoehorns onto the garment slipped on and kept into an opening position thereon;

a plurality of handles configured to be gripped and handled, and configured to allow use of the device;

a coupling joint interposed between said shoehorns, said coupling joint being configured to allow a reversible connection of the shoehorns to each other and reciprocal movement thereof, the coupling joint comprising quick engagement means configured to be associated to two adjacent walls of said shoehorns, the quick engagement means being selected from a pair of grooved plates configured to be inserted onto two adjacent walls of said shoehorns, hook and loop fasteners, and snap buttons.

2. The device according to claim 1, wherein the coupling joint is reversibly connectable to at least one of said shoehorns.

3. The device according to claim 1, wherein the coupling joint comprises an elastic mechanical element.

4. The device according to claim 3, wherein said mechanical elastic element is a spring.

5. The device according to claim 2, wherein the coupling joint comprises an elastic mechanical element.

6. The device according to claim 5, wherein said mechanical elastic element is a spring.

* * * * *